US012104481B2

(12) United States Patent
Sridhar et al.

(10) Patent No.: US 12,104,481 B2
(45) Date of Patent: Oct. 1, 2024

(54) AUTOMATIC REAL TIME SCREEN-OUT MITIGATION

(71) Applicant: Halliburton Energy Services, Inc., Houston, TX (US)

(72) Inventors: Srividhya Sridhar, Houston, TX (US); Joseph Andrew Romani, Denver, CO (US); Dinesh Ananda Shetty, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/825,045

(22) Filed: May 26, 2022

(65) Prior Publication Data

US 2023/0383639 A1 Nov. 30, 2023

(51) Int. Cl.

| | |
|---|---|
| ***E21B 43/267*** | (2006.01) |
| ***E21B 34/10*** | (2006.01) |
| ***E21B 44/00*** | (2006.01) |
| ***E21B 47/06*** | (2012.01) |
| ***E21B 47/09*** | (2012.01) |

(52) U.S. Cl.

CPC ..... *E21B 44/005* (2013.01); *E21B 34/10* (2013.01); *E21B 43/267* (2013.01); *E21B 47/06* (2013.01); *E21B 47/09* (2013.01)

(58) Field of Classification Search

CPC ..... E21B 43/267; E21B 47/06; E21B 47/09

See application file for complete search history.

(56) References Cited

U.S. PATENT DOCUMENTS

| | | | | |
|---|---|---|---|---|
| 5,183,109 | A | 2/1993 | Poulsen | |
| 6,935,424 | B2 | 8/2005 | Lehman et al. | |
| 9,803,467 | B2 * | 10/2017 | Tang | E21B 43/267 |
| 10,030,473 | B2 | 7/2018 | Tolman et al. | |
| 10,961,835 | B2 * | 3/2021 | Mazrooee | F04B 49/00 |
| 11,066,915 | B1 | 7/2021 | Yeung et al. | |
| 2016/0273346 | A1 | 9/2016 | Tang et al. | |
| 2016/0298439 | A1 | 10/2016 | Morrow et al. | |

FOREIGN PATENT DOCUMENTS

WO 2021061567 A1 4/2021

OTHER PUBLICATIONS

Massaras, et al.; "Real-time Advanced Warning of Screenouts with the Inverse Slope Method"; SPE International; SPE 150263; SPE International Symposium and Exhibition on formation Damage Control; Feb. 15-17, 2012; 9 pgs.

(Continued)

*Primary Examiner* — Catherine Loikith

(74) *Attorney, Agent, or Firm* — Michael Jenney; Parker Justiss, P.C.

(57) ABSTRACT

Processes for mitigating wellbore screen-out. The processes can automatically determine an onset of wellbore screen-out by analyzing corrected pressure data from the at least one pressure sensor, select at least one type of mitigation action based on the automatic determination of the onset of the wellbore screen-out, and mitigate the wellbore screen-out with the selected at least one type of mitigation action.

20 Claims, 9 Drawing Sheets

(56) References Cited

OTHER PUBLICATIONS

Narasingam, et al.; "Application of Koopman operator for model-based control of fracture propagation and proppant transport in hydraulic fracturing operation"; Elsevier; Journal of Process Control; May 10, 2020; 12 pgs. www.elsevier.com/locate/jprocont https://doi.org/10.1016/j.jprocont.2020.05.003.

Cai, et al.; "Semi Analytical Model for Predicting Screen-out in Hydraulic Fracturing in Vertical Wells"; J. Natural Gas Eng., vol. 2, No. 1; DOI: 10.7569/JNGE.2016.692508; Jun. 2017; 19 pgs.

* cited by examiner

300

700

AUTOMATIC REAL TIME SCREEN-OUT MITIGATION

TECHNICAL FIELD OF THE DISCLOSURE

The present disclosure relates generally to the design of fracturing treatments for stimulating hydrocarbon production from subsurface reservoirs and, particularly, to techniques to mitigate screen-outs during those stimulation treatments.

BACKGROUND

In the oil and gas industry, a well that is not producing as expected may need stimulation to increase production of subsurface hydrocarbon deposits, such as oil and natural gas. Hydraulic fracturing is a type of stimulation treatment that has long been used for well stimulation in unconventional reservoirs. A stimulation treatment operation may involve drilling a horizontal wellbore and injecting treatment fluid into a surrounding formation in multiple stages via a series of perforations or entry points along a path of a wellbore through the formation. During each stimulation treatment, different types of fracturing fluids, proppant materials (e.g., sand), additives, and/or other materials may be pumped into the formation via the entry points or perforations at high pressures and/or rates to initiate and propagate fractures within the formation to a desired extent.

SUMMARY OF THE DISCLOSURE

In one aspect, a method of mitigating wellbore screen-out is disclosed. In one embodiment, the method includes (1) automatically determining an onset of wellbore screen-out by analyzing corrected pressure data from a hydraulic fracturing well site, (2) selecting at least one type of mitigation action based on the automatic determination of the onset of the wellbore screen-out, and (3) mitigating the wellbore screen-out with the selected at least one type of mitigation action.

In a second aspect, a system for mitigating wellbore screen-out is disclosed. In one embodiment, the system includes at least one surface pressure sensor and at least one processor. The at least one processor is configured to perform operations including (1) automatically determining an onset of wellbore screen-out by analyzing corrected pressure data from the at least one pressure sensor, (2) selecting at least one type of mitigation action based on the automatic determination of the onset of the wellbore screen-out, and (3) mitigating the wellbore screen-out with the selected at least one type of mitigation action.

In a third aspect, a computer program product computer program product having a series of operating instructions stored on a non-transitory computer-readable medium that cause at least one processor to perform operations to mitigate wellbore screen-out is disclosed. In one embodiment, the operations include (1) automatically determining an onset of wellbore screen-out by analyzing corrected pressure data from a hydraulic fracturing well site, (2) selecting at least one type of mitigation action based on the automatic determination of the onset of the wellbore screen-out, and (3) mitigating the wellbore screen-out with the at least one type of mitigation action

BRIEF DESCRIPTION OF THE DRAWINGS

Reference is now made to the following descriptions taken in conjunction with the accompanying drawings, in which.

DETAILED DESCRIPTION

Sometimes a dangerous phenomenon known as screen-out can occur during the fracture operation. A screen-out occurs when a fluid path is blocked by materials such as proppant, sand, etc. leading to increased resistance to the fluid flow, which can happen near the wellbore or far from the wellbore. The screen-out may ultimately result in a blow out of the well. Therefore, especially for automated fracturing operations, it is imperative to detect the onset of a screen-out and take appropriate mitigation action in real time to complete the stimulation operation (i.e., pump all the planned proppant or pump the maximum proppant without causing wellbore screen-out). At present, human monitoring is used to detect the onset of screen-out which is very susceptible to oversight and error and, thus, mitigation actions taken to complete the stimulation operation are also very susceptible to oversight and error.

Figure 1:
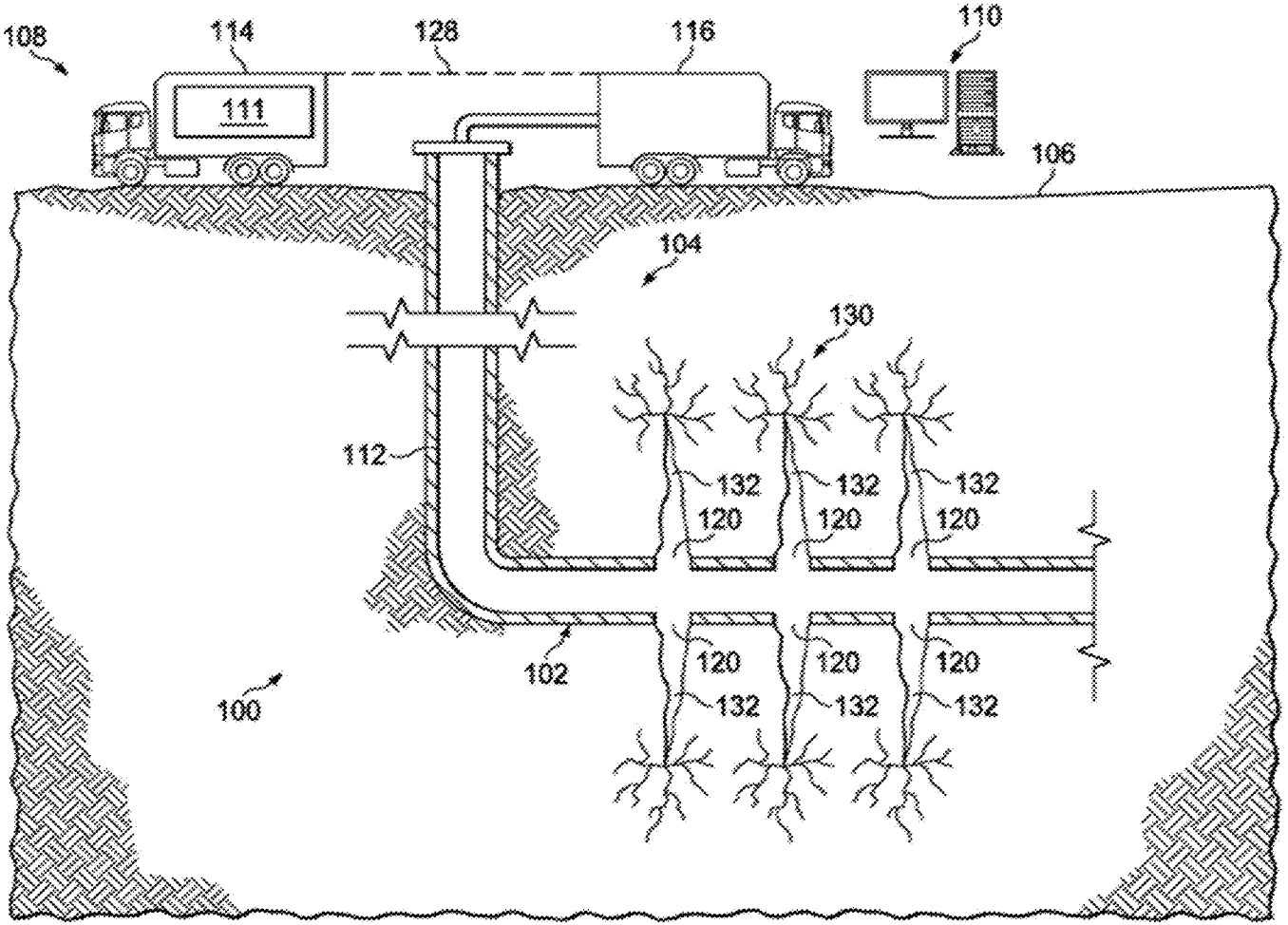
FIG. 1 illustrates an example hydraulic fracturing operation.

FIG. 1 shows an environment 100 of an illustrative hydraulic fracturing operation together with a symbolic computing subsystem 110. A wellbore 102 extends into a subterranean region 104 beneath the ground surface 106. Typically, the subterranean region 104 includes a reservoir that contains hydrocarbon resources such as oil or natural gas. For example, the subterranean region 104 may include all or part of a rock formation (e.g., shale, coal, sandstone, granite, or others) that contains natural gas. The subterranean region 104 may include naturally fractured rock or natural rock formations that are not fractured to any significant degree. When the subterranean region 104 includes tight gas formations (i.e., natural gas trapped in low permeability rock such as shale), it is typically desirable to increase the degree of fracturing in the formation to increase the formation's effective permeability.

Accordingly, FIG. 1 also shows an injection assembly 108 coupled to a conduit 112 in wellbore 102. The injection assembly 108 includes one or more instrument trucks 114, represented by a single instrument truck in FIG. 1, and one or more pump trucks 116, represented by a single pump truck in FIG. 1, that operate to inject fluid via the conduit 112 into the subterranean region 104, thereby opening existing fractures and creating new fractures. The fluid reaches the formation via one or more fluid injection locations 120, which in many cases are perforations in the conduit 112. The conduit 112 may include casing cemented to the wall of the wellbore 102, though this is not a requirement. In some implementations, all or a portion of the wellbore 102 may be left open, without casing. The conduit 112 may include a working string, coiled tubing, sectioned pipe, or other types of conduit.

The fracture treatment may employ a single injection of fluid to one or more fluid injection locations, or it may employ multiple such injections, optionally with different fluids. Where multiple fluid injection locations are employed, they can be stimulated concurrently or in stages. Moreover, they need not be located within the same wellbore, but may for example be distributed across multiple wells or multiple laterals within a well. An injection treatment control subsystem 111 coordinates operation of the injection assembly components to monitor and control the fracture treatment. It may rely on computing subsystem 110, which represents the various data acquisition and processing subsystems optionally distributed throughout the injection assembly 108 and wellbore 102, as well as any remotely coupled offsite computing facilities available to the injection treatment control subsystem 111.

The pump trucks 116 can include mobile vehicles, immobile installations, skids, hoses, tubes, fluid tanks, fluid reservoirs, pumps, valves, mixers, or other types of structures and equipment. They can supply treatment fluid and other materials (e.g., proppants, stop-loss materials) for the injection treatment. The illustrated pump trucks 116 communicate treatment fluids into the wellbore 102 at or near the level of the ground surface 106. The pump trucks 116 are coupled to valves and pump controls for starting, monitoring, stopping, increasing, decreasing or otherwise controlling pumping as well as controls for selecting or otherwise controlling fluids pumped during the injection treatment.

The instrument trucks 114 can include mobile vehicles, immobile installations, or other suitable structures and sensors for measuring temperatures, pressures, flow rates, and other treatment and production parameters. The example instrument trucks 114 shown in FIG. 1 include injection treatment control subsystem 111 that controls or monitors the injection treatment applied by the injection assembly 108. The injection assembly 108 may inject fluid into the formation above, at, or below a fracture initiation pressure; above, at, or below a fracture closure pressure; or at another fluid pressure.

Communication links 128 enable the instrument trucks 114 to communicate with the pump trucks 116, and other equipment at the ground surface 106. Additional communication links enable the instrument trucks 114 to communicate with sensors or data collection apparatus in the wellbore 102, other wellbores, remote facilities, and other devices and equipment. The communication links can include wired or wireless communications assemblies, or a combination thereof.

The injection treatment control subsystem 111 may include data processing equipment, communication equipment, or other assemblies that control injection treatments applied to the subterranean region 104 through the wellbore 102. The injection treatment control subsystem 111 may be communicably linked to the computing subsystem 110 that can calculate, select, or optimize treatment parameters for initiating, opening, and propagating fractures in the subterranean region 104. The injection treatment control subsystem 111 may receive, generate, or modify an injection treatment plan (e.g., a pumping schedule) that specifies properties of an injection treatment to be applied to the subterranean region 104. Injection treatment control subsystem 111 shown in FIG. 1 controls operation of the injection assembly 108.

FIG. 1 shows that an injection treatment has fractured the subterranean region 104. FIG. 1 shows examples of dominant fractures 132 extending into natural fracture networks 130, the dominant fractures having been formed and opened by fluid injection through perforations 120 along the wellbore 102. Generally, induced fractures may extend through naturally fractured rock, regions of un-fractured rock, or both. The injected fracturing fluid can flow from the dominant fractures 132, into the rock matrix, into the natural fracture networks 130, or in other locations in the subterranean region 104. The injected fracturing fluid can, in some instances, dilate or propagate the natural fractures or other pre-existing fractures in the rock formation. It should be noted that the induced hydraulic fractures can interact with each other and with the existing natural fractures, thus generating a complex fracture network structure.

Real-time observations may be obtained from pressure meters, flow monitors, microseismic equipment, tiltmeters, or such equipment. For example, pump truck 116 may include pressure sensors and flow monitors to monitor a pressure and flow rate of the hydraulic fracturing fluid at the surface 106 during a stimulation operation. These pressure and flow measurements can be used to detect the onset of screen-out from which mitigation actions can be taken to complete the stimulation operation.

Some of the techniques and operations described herein may be implemented by a one or more computing assemblies configured to provide the functionality described. In various instances, a computing assembly may include any of various types of devices, including, but not limited to, handheld mobile devices, tablets, notebooks, laptops, desktop computers, workstations, mainframes, distributed computing networks, and virtual (cloud) computing systems. In addition to the functions described above, the computing subsystem 110, the injection treatment control subsystem 111, or a combination of both can be configured to perform or direct operation of the illustrative systems and methods described herein. For example, the system for mitigating wellbore screen-out 1000, such illustrated in FIG. 10, or the method 900 of FIG. 9 can be implemented at least in part by the computing subsystem 110, the injection treatment control subsystem 111, or a combination thereof.

The illustrative systems and method described herein automatically determine the onset of screen-out by analyzing a pressure response from a well in real time to take an appropriate mitigation action. A surface pressure response, P, is measured, e.g., with pressure sensors in the pump trucks 116 as described above from a hydraulic fracturing operation once proppant has been started in the wellbore. The surface pressure response, P, is corrected by removing the effect of density change of the fluid system and frictional effects as illustrated by, for example, Equation 1:

$$\tilde{P}=+P_h(\rho,\mathrm{TVD})-P_{fric}(Q,d,k',n',\ldots)-P_{frac}(Q,E,\mu,\ldots)-\sigma_{net}, \quad \text{Eq.1}$$

where $\tilde{P}$ is the corrected pressure, $P_h$ is a hydrostatic pressure factor contribution, ρ is density, TVD is a total vertical depth, $P_{fric}$ is a friction factor pressure contribution, Q is a rate at which slurry (typically a mixture of water, chemicals, and proppant, etc.) is being pumped into the wellbore at the surface, d is an inner diameter of the wellbore, k' is a flow consistency index of the fluid, n' is a flow behavior index of the fluid, $P_{frac}$ is a fracture pressure contribution, E is Young's modulus of the formation, μ is an effective fluid viscosity, and $\sigma_{net}$ is a net stress acting on the fracture. Hydrostatic pressure can be computed according to Equation 2:

$$P_h=(\rho gTVD), \quad \text{Eq. 2}$$

where ρ is density, TVD is total vertical depth, and g is acceleration due to gravity. Hydrostatic pressure ($P_h$), friction factor contribution ($P_{fric}$), and fracture pressure contribution ($P_{frac}$) terms may be derived from appropriate models, e.g., non-newtonian friction models, perforation friction models, tortuosity friction models, PKN/KGD (Perkins-Kern-Nordgren/Khristianovic-Geertsma-de Klerk) type of models, or any other suitable models, as would be understood by those ordinarily skilled in the art of having benefit of this disclosure. Further if additional downhole pressure data is available, that data can be used to extract wellbore friction.

In some exemplary embodiments, simplification of the mathematical calculations can be achieved by assuming the fracture pressure is negligible, the net stress action on the fracture is constant, and the friction pressure remains constant for the duration of rate and fluid properties being constant.

Figure 2:
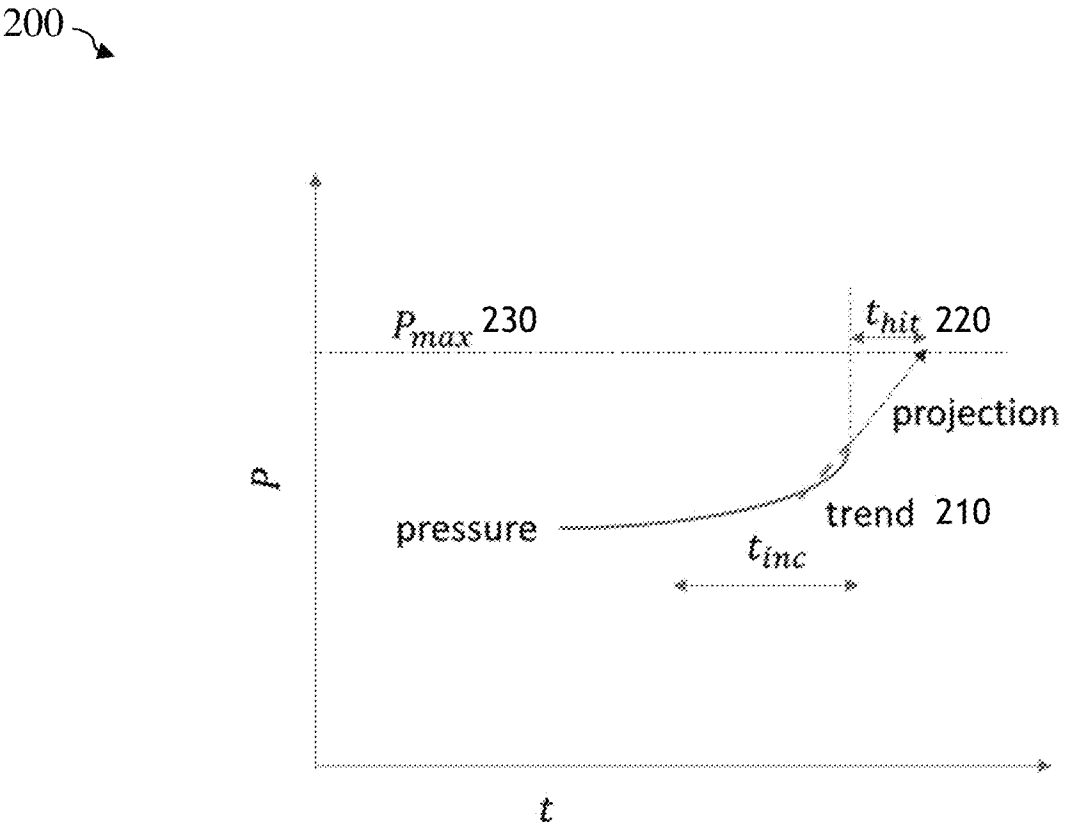
FIG. 2 illustrates a response trend for a corrected surface pressure of fracturing fluid introduced into a wellbore.

FIG. 2 is a graph 200 of a response trend for the corrected pressure, $\tilde{P}$ 210. If the trajectory of the pressure response trend ($\tilde{P}+\Delta\tilde{P}$, i.e., corrected pressure $\tilde{P}$ plus corrected pressure raise $\Delta\tilde{P}$) is flat or in a downward trend, the pressure response continues to be monitored but no corrective is needed. However, if the trajectory is in a positive or upward trend (i.e., an increasing trend), a time it takes for $\tilde{P}+\Delta\tilde{P}$ to exceed a maximum allowable pressure, $t_{hit}$ 220, is estimated from the trajectory of $\tilde{P}+\Delta\tilde{P}$. The maximum allowable pressure, $P_{max}$ 230, can come from equipment/operational safety limits or some other criteria. A wellbore traverse time ($t_{sweep}$), i.e., the time required to move one wellbore volume of fluid at a present slurry rate is determined. $t_{ratio}$ is a ratio of the estimated time it takes for $\tilde{P}+\Delta P$ to exceed a maximum allowable pressure ($t_{hit}$) to the wellbore traverse time ($t_{sweep}$), i.e., $$t_{ratio} = \frac{t_{hit}}{t_{sweep}}.$$

If $t_{ratio} \leq C_1$ then screen-out can be predicted or detected and a corrective action is needed. ($C_1$ also refers to the value of $t_{ratio}$ above which no correction is needed.) A value of $C_1$ can be, e.g., 1 or 1.1. The value of $C_1$ may remain fixed or may vary during the fracturing operation, e.g., a smaller value of $C_1$ may be adapted, such as 0.5, at an early part of proppant pumping and a larger value of $C_1$ may be adapted at a later time of proppant pumping. However, the corrective action depends on the value of $t_{ratio}$ as will be described below.

When a screen-out condition is detected, a model developed based on previous field data can be used to generate appropriate corrective actions. The corrective action can be, e.g., altering proppant concentration, adjusting a fluid rheology by changing friction reducer concentration or based on other chemical additives, or changing a slurry pumping rate. Thus, corrective actions can involve proppant control or slurry rate control.

Figure 3:
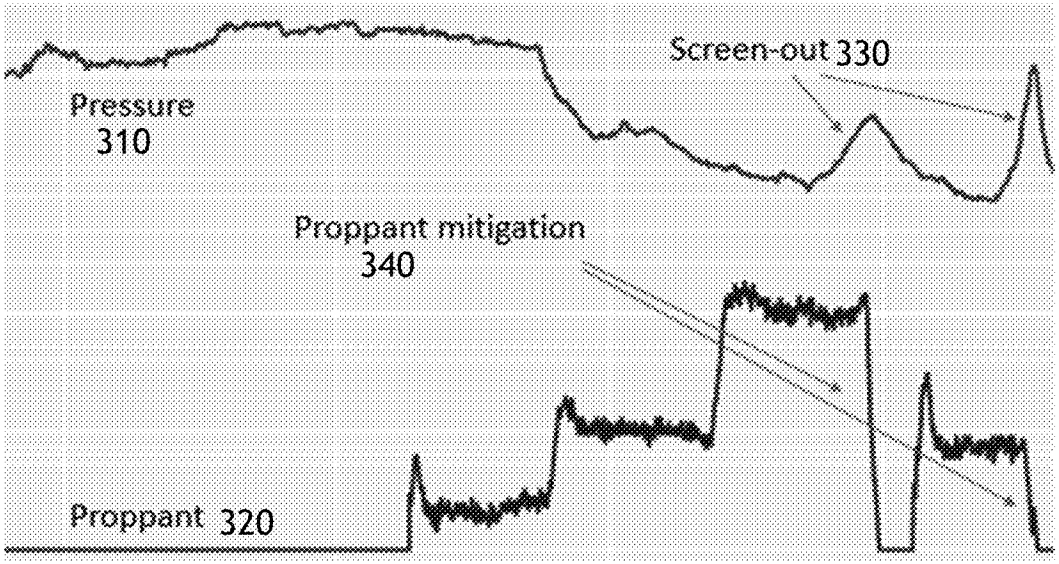
FIG. 3 illustrates field data collected which identifies screen-out conditions and corresponding proppant mitigations based on surface pressure and proppant concentration.

FIG. 3 illustrates field data 300 collected and analyzed when proppant corrective actions have been performed. FIG. 3 illustrates a surface pressure 310 for a wellbore over time as well as a proppant concentration 320 (introduced into the wellbore) over time. From the surface pressure plot, screen-out conditions 330 are identified and from the proppant concentration plot, corresponding proppant mitigation actions 340 are identified. Once relevant data is identified, which may be done manually or via automated algorithms that detects change in the levels, all of the features associated with different scenarios are analyzed to determine correlation. This process may involve developing random forest, decision-tree, clustering/classification, or any other appropriate technique to identify a suitable proppant control model. A recommendation from the proppant control model may be continuous proppant concentration or proppant concentration adjustments in steps. One possibility is identifying screen-out conditions that favor holding the proppant concentration constant at a current level or favor completely reducing the proppant concentration to zero (as depicted in FIG. 3). Other possibilities include identifying specific proppant concentration adjustments in different screen-out scenarios.

Figure 4:
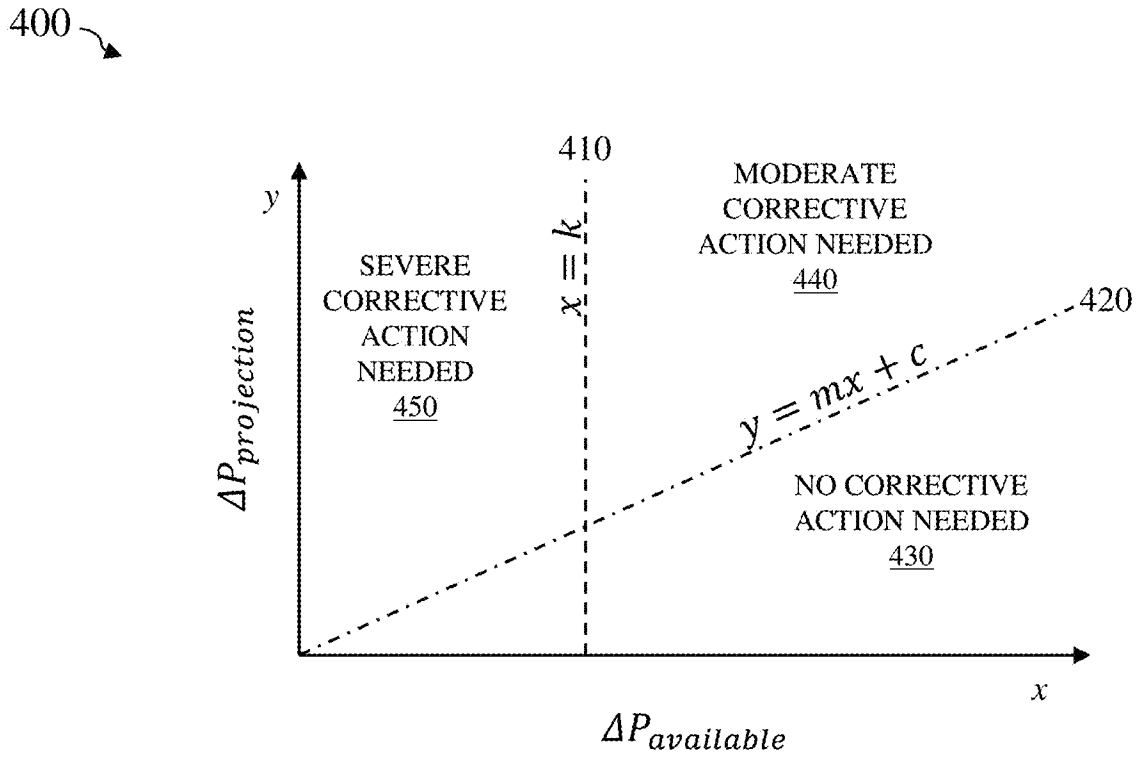
FIG. 4 illustrates an example of a proppant control model.
Figure 6:
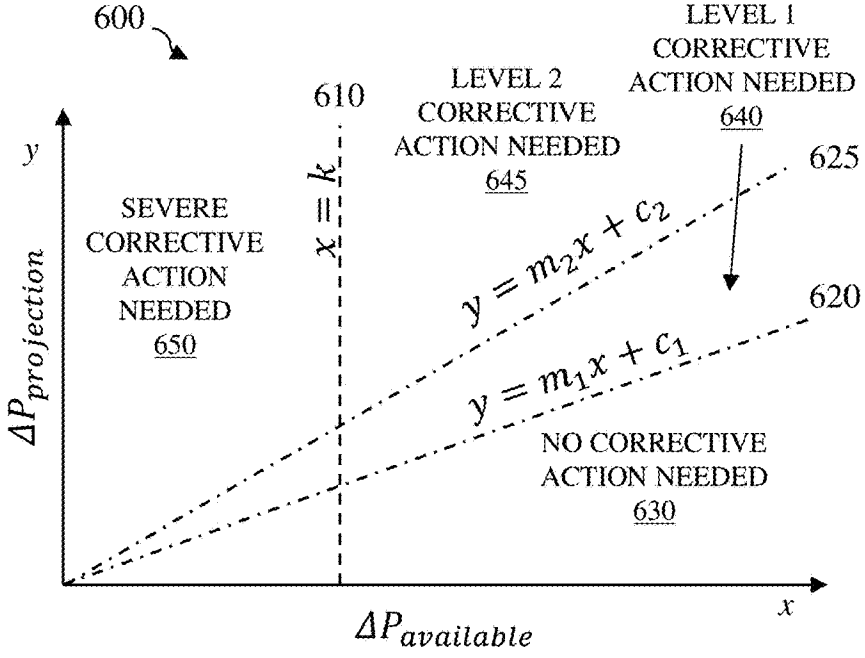
FIG. 6 illustrates another alternative example of a proppant control model.
Figure 5:
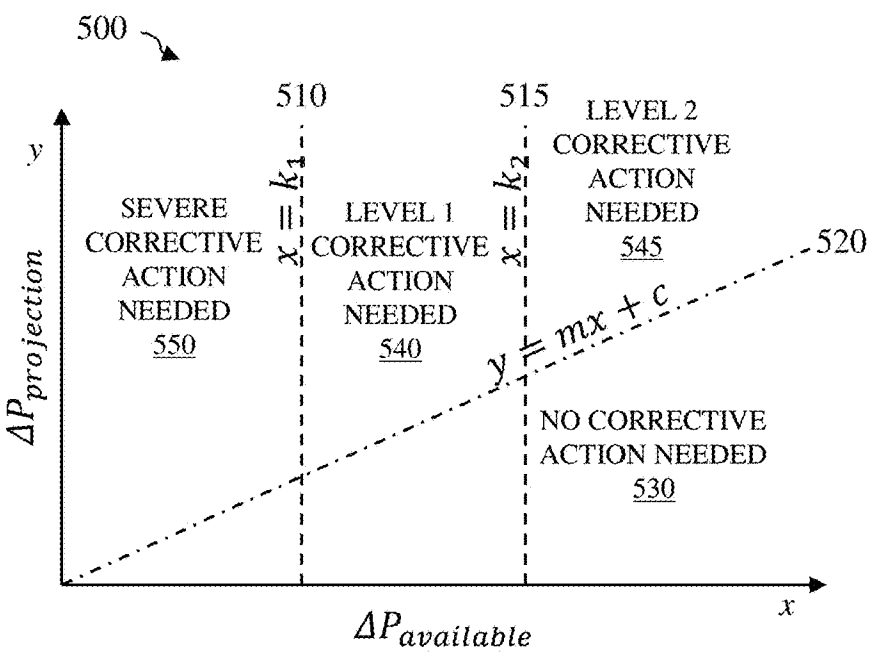
FIG. 5 illustrates an alternative example of a proppant control model.

FIGS. 4-6 illustrate proppant control rate models with different proppant concentration adjustment corrective actions, i.e., proppant control corrective actions, for different screen-out scenarios. In FIGS. 4-6, the y-axis, labeled as $\Delta P_{projection}$, represents risk. In some implementations, an estimation of pressure increase in one wellbore sweep time, e.g., $t_{sweep}$, is considered as this risk. This risk, $\Delta P_{projection}$, can be derived from the automatic determination of onset of a wellbore screen-out condition as described above with regard to FIG. 2. In FIGS. 4-6, the x-axis, labeled as $\Delta P_{available}$, represents a safety window. In some implementations, this safety window may be considered as the difference between a maximum allowable pressure, $P_{max}$ (e.g., the maximum allowable pressure described above), and a pressure of the treatment fluid, $P_{treatment}$ (e.g., the surface pressure response, P, or corrected pressure, $\tilde{P}$, as described above), or $P_{max}-P_{treatment}$. But any other suitable quantities can be substituted.

FIG. 4 illustrates a scenario 400 where proppant control corrective action recommendations are classified into three distinct regions. Line 420, in the form of y=mx+c, where m and c are derived from the data analysis described above, delineates between when a corrective action is needed to mitigate the wellbore screen-out condition and when a corrective action is not needed, e.g., when the value for $C_1$ for $t_{ratio}$ is above a value in which no correction is needed. When $P_{treatment}$ (the surface pressure response, P, or corrected pressure, $\tilde{P}$, as described above) falls below line 420, there is enough safety window, $\Delta P_{available}$, to handle the risk, $P_{projection}$, and, thus, no corrective actions are needed as represented by a first of the three distinct regions, region 430 of FIG. 1. However, when treatment is $P_{treatment}$ above line 420, there is not enough safety window, $\Delta P_{available}$, to handle the risk, $P_{projection}$, and, thus, a proppant control corrective action is required to mitigate the wellbore screen-out condition as represented by the second and third of the three distinct regions, regions 440 and 450 of FIG. 1.

The type of proppant control corrective action needed to mitigate the wellbore screen-out condition can be also determined from the data analysis described above. Examples of types of needed corrective actions illustrated in FIG. 4 are moderate corrective actions and severe corrective actions. In cases where $P_{treatment}$ is above line 420 (there is not enough safety window, $\Delta P_{available}$, to handle the risk, $P_{projection}$) and the safety window, $\Delta P_{available}$, is above a threshold k (determined from the data analysis above), a moderate type of proppant control corrective action is needed as represented by region 440 of FIG. 4. In cases where $P_{treatment}$ is above line 420 (there is not enough safety window, $\Delta P_{available}$, to handle the risk, $P_{projection}$) and the safety window, $\Delta P_{available}$, is below threshold k, a severe type of proppant control corrective action is needed as represented by region 450 of FIG. 4. Examples of proppant control corrective actions, as described above, include, e.g., altering proppant concentration and/or adjusting a fluid rheology by changing friction reducer concentration or based on other chemical additives.

FIG. 5 illustrates a scenario 500 where proppant control corrective action recommendations are classified into four distinct regions. Line 520 is similar to line 420 of FIG. 4 and line 510 is similar to line 410 of FIG. 4, where $k_1$ of line 510 is similar to k of line 410. Regions 530 and 550 are similar to regions 430 and 450 of FIG. 4. However, rather than including only a single moderate type of proppant control, as represented by region 440 in FIG. 4, scenario 500 of FIG. 5 illustrates a level 1 and level 2 type of proppant control, as represented by regions 540 and 545, respectively. In cases where $P_{treatment}$ is above line 420 (there is not enough safety window, $\Delta P_{available}$, to handle the risk, $P_{projection}$) and the safety window, $\Delta P_{available}$, is above a threshold $k_1$ (determined from the data analysis above) as represented by line 510, a level 1 type of proppant control corrective action is needed as represented by region 540 of FIG. 5. In cases where $P_{treatment}$ is above line 520 (there is not enough safety window, $\Delta P_{available}$, to handle the risk, $P_{projection}$) and the safety window, $\Delta P_{available}$, is above threshold $k_2$ as represented by line 515, a level 2 type of proppant control corrective action is needed as represented by region 545 of FIG. 5. Of course, additional types of proppant control corrective actions could be defined by differing levels of threshold $k_n$, as determined from the data analysis described above.

Similar to FIG. 5, FIG. 6 illustrates a scenario 600 where proppant control corrective action recommendations are also classified into four distinct regions. However, rather than level 1 or level 2 types of needed proppant corrective actions being based on a different threshold $k_2$ as illustrated in FIG. 4, scenario 600 illustrates level 1 and level 2 types of needed proppant control corrective actions are based on an additional delineation of when a proppant control corrective action is needed to mitigate the wellbore screen-out condition. Similar to line 420 of FIG. 4 and line 520 of FIG. 5, scenario 600 illustrates line 620 in the form of $y=m_1x+c_1$, where $m_1$ and $c_1$ are derived from the data analysis described above, which similarly delineates between when a proppant control corrective action is needed to mitigate the wellbore screen-out condition and when a corrective action is not needed. Scenario 600 illustrates a second line 625 in the form of $y=m_2x+c_2$, where $m_2$ and $c_2$ are derived from the data analysis described above, which delineate between when a level 1 proppant control corrective action is needed and when a level 2 proppant control corrective action is needed. Thus, when $P_{treatment}$ is above line 620 (there is not enough safety window, $\Delta P_{available}$, to handle the risk, $P_{projection}$) and the safety window, $\Delta P_{available}$, is above a threshold k (determined from the data analysis above) as represented by line 610, but $P_{treatment}$ is below line 625, a level 1 type of proppant control corrective action is needed as represented by region 640 of FIG. 6. In cases when $P_{treatment}$ is above line 625 (and the safety window, $\Delta P_{available}$, is above a threshold k), a level 2 type of proppant control corrective action is needed as represented by region 645 of FIG. 6.

It should be noted that the coefficients derived from the data analysis may change based on other features. For example, the values of coefficients m, c, and k may vary from region to region or may be based on an average treatment pressure, $P_{treatment}$, etc. Further, the proppant control model deployed from the data analysis may allow a user to modify these coefficients.

As noted above, when a screen-out condition is detected, a model developed based on previous field data can be used to generate appropriate corrective actions and these corrective actions can involve proppant control or slurry rate control. Described above are a proppant control model and proppant control corrective actions. Described below are slurry rate control model and slurry rate control corrective actions. As with proppant control corrective actions, slurry rate control corrective actions, too, use a model based on field data.

Figure 7:
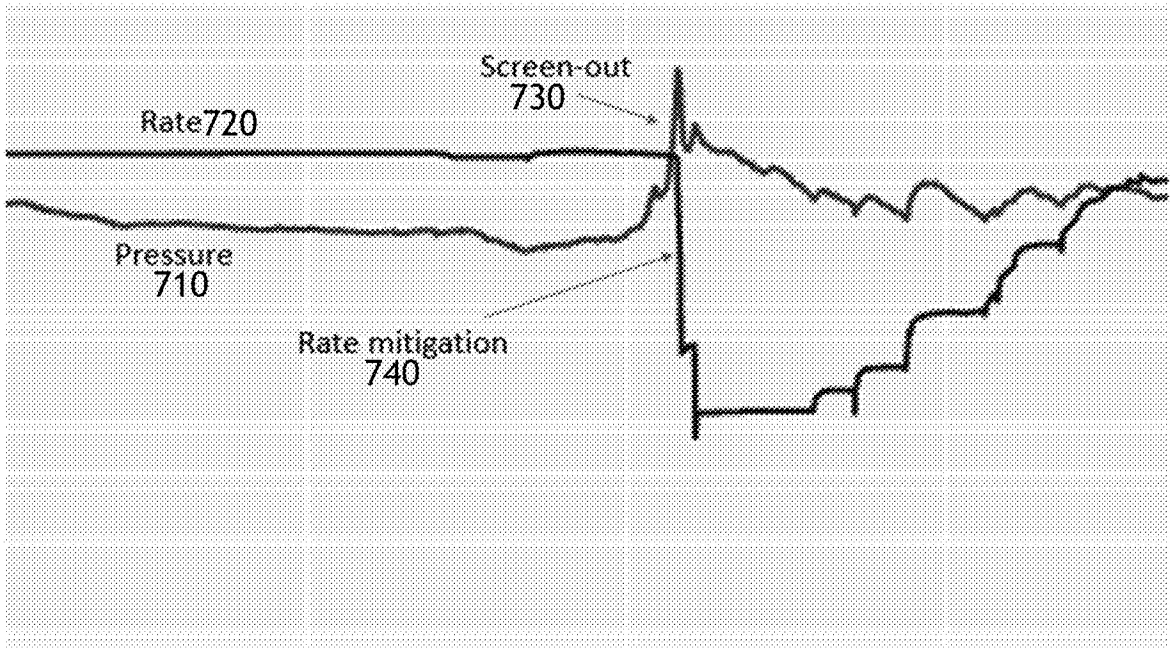
FIG. 7 illustrates field data collected which identifies screen-out conditions and corresponding slurry rate mitigations based on surface pressure and slurry rate.

FIG. 7 illustrates field data 700 collected and analyzed when slurry rate corrective actions have been performed. FIG. 7 illustrates a surface pressure 710 for a wellbore over time as well as a slurry rate 720 (of slurry introduced into the wellbore) over time. From the surface pressure plot, screen-out conditions 730 are identified and from the slurry rate plot, corresponding proppant mitigation actions 740 are identified. Once relevant data is identified, which may be done manually or via automated algorithms that detects change in the levels, then all of the features associated with different scenarios are analyzed to determine correlation. This process may involve developing random forest, decision-tree, clustering/classification, or any other appropriate technique to identify a suitable slurry rate model. A recommendation from the slurry rate model may be continuous slurry rate or slurry rate adjustments in steps. One possibility is identifying screen-out conditions that favor dropping the slurry rate by a large amount (e.g., 7 bpm) or favor dropping the slurry rate by a small amount (e.g., 3 bpm). Other possibilities include identifying specific slurry rate adjustments in different screen-out scenarios. The output of the slurry rate model may be a relative slurry rate change or an actual slurry rate change.

Figure 8:
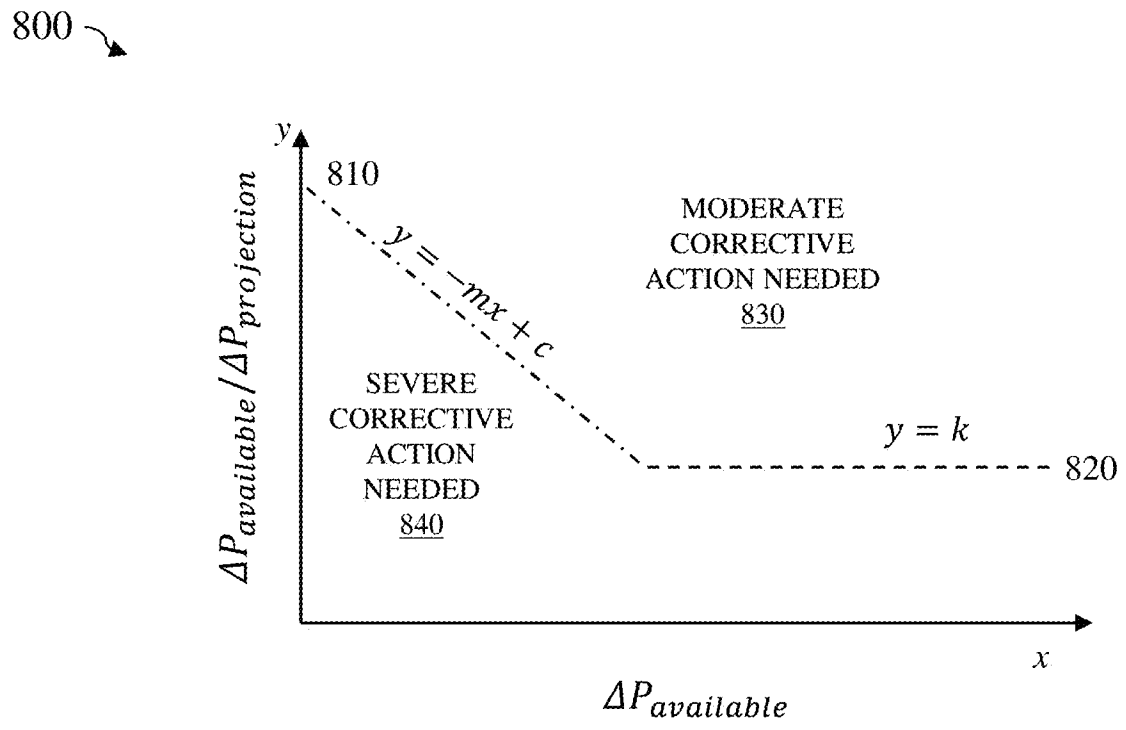
FIG. 8 illustrates an example of a slurry control model.

FIG. 8 illustrates an example of a slurry rate model. FIG. 8 illustrates a scenario 800 where slurry rate corrective action recommendations are classified into two distinct regions, 830 and 840. In FIG. 8, the x-axis, labeled as $\Delta P_{available}$, represents a safety window similar to the x-axis in the proppant control models of FIGS. 4-6. In some implementations, this safety window may be considered as the difference between a maximum allowable pressure, $P_{max}$ (e.g., the maximum allowable pressure described above), and a pressure of the treatment fluid, $P_{treatment}$ (e.g., the surface pressure response, P, or corrected pressure, $\tilde{P}$, as described above), or $P_{max}-P_{treatment}$, but any other suitable quantities can be substituted. In FIG. 8, the y-axis, labeled as $\Delta P_{available}/\Delta P_{projection}$, represents risk. This risk can be derived from the automatic determination of onset of a wellbore screen-out condition as described above with regard to FIG. 2. In contrast to the scenarios in FIGS. 4-6 where the risk is represented solely by $\Delta P_{projection}$, i.e., an estimation of pressure increase in one wellbore sweep time, e.g., $t_{sweep}$, the risk in the slurry rate control model of FIG. 8 is a relative measure of the safety window, $\Delta P_{available}$, to the risk $\Delta P_{projection}$.

Lines 810 and 820 of FIG. 8, in the form of $y=-mx+c$, and $y=k$, respectively, where m, c, and k are derived from the data analysis described above, delineates between when a moderate slurry rate control corrective action 830 is needed to mitigate the wellbore screen-out condition and when a severe slurry rate control corrective action 840 is needed. For larger safety windows ($\Delta P_{available}$), when $P_{treatment}$ (the surface pressure response, P, or corrected pressure, $\tilde{P}$, as described above) is above a risk ($\Delta P_{available}/\Delta P_{projection}$) threshold k (line 820), only moderate slurry rate control corrective actions are needed. However, for smaller safety windows ($\Delta P_{available}$), $P_{treatment}$ must be above line 810 to require a moderate slurry rate control corrective action. Otherwise, when $P_{treatment}$ is below line 810, severe slurry rate control corrective action is needed. Slurry rate control corrective actions primary involve changing a slurry pumping rate.

While FIG. 8 depicts only two distinct slurry rate corrective action regions (830, 840), the slurry rate model may involve more slurry rate corrective action regions. As with the proppant control model, coefficients m, c, and k may be updated on site for the slurry rate control model. Furthermore, rather than proppant control model or a slurry rate control model, a friction reducer model can follow a similar approach as that described above with the proppant control model.

It should be understood that these individual models may provide corrective action recommendations independently for screen-out mitigation or they may take into consideration other recommendations. For example, if a large proppant concentration drop is recommended by the proppant control model, then the slurry rate control model may recommend small slurry rate cuts in anticipation of an improved situation. Recommendations may be sent to an equipment controller, such as computing subsystem 110, injection treatment control subsystem 111, or a combination thereof of FIG. 1 described above. The equipment controller may implement an automatic closed-loop control or may display recommendations to a user on a screen of the equipment controller for a user to act upon as open-loop control. The above-noted models may be updated in real time based on how the screen-out mitigation is proceeding or if the user accepts the recommendations.

Figure 9:
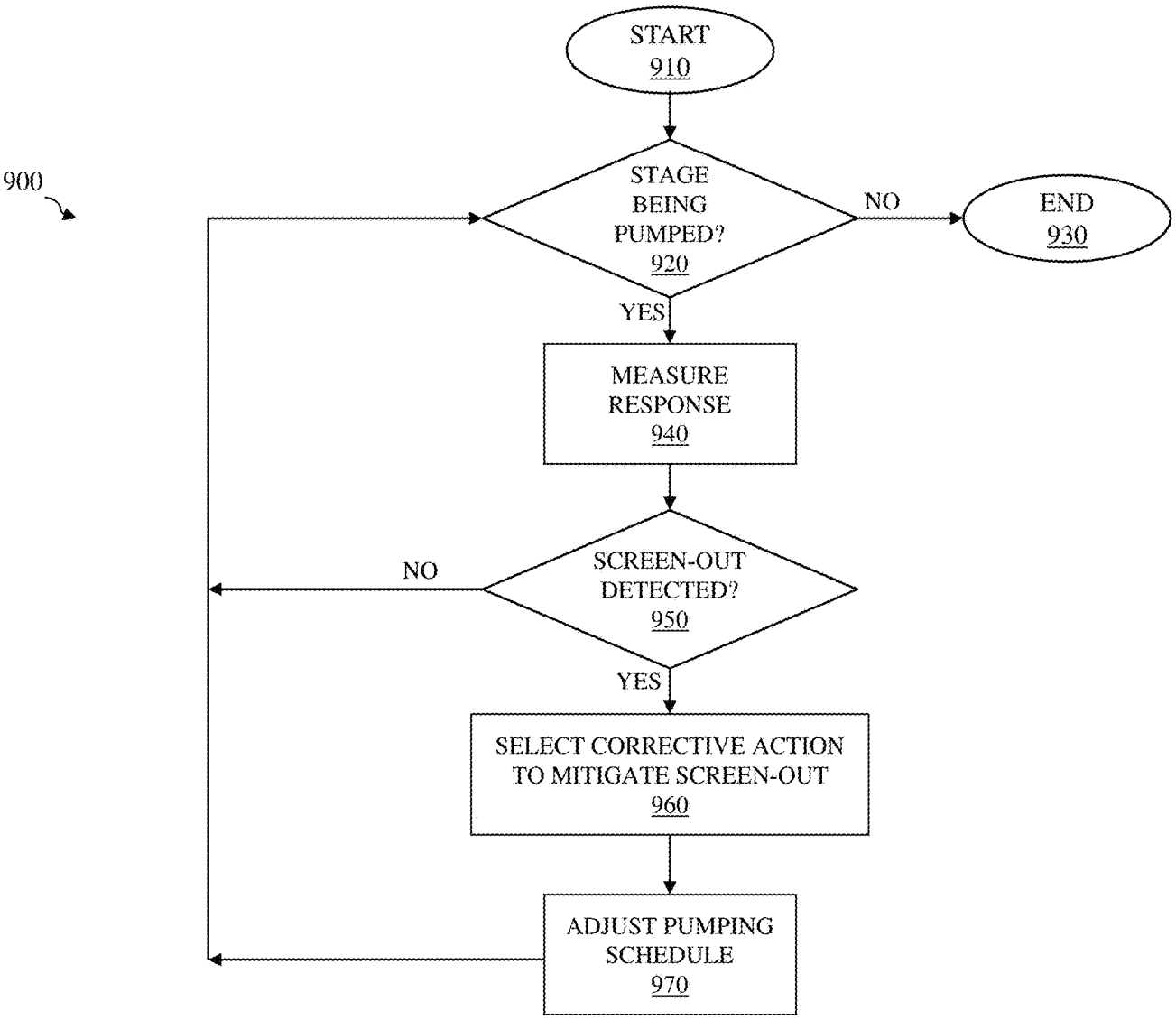
FIG. 9 illustrates a flow diagram of an example for screen-out mitigation corrective action according to principles of the disclosure.

FIG. 9 illustrates a flow diagram of an example of method a 900 of screen-out mitigation corrective action carried out according to the principles of the disclosure. At least a portion of method 900 can be performed by a system for mitigating wellbore screen-out, such as disclosed in FIG. 10. Method 900 starts in step 910. At step 920, it is determined if a particular fracturing stage is being pumped. Pump trucks 116 of FIG. 1 are an example of equipment used to pump, e.g., fracturing fluid and proppant, into wellbore 102. If a particular fracturing stage is not being pumped, method 900 proceeds to step 930 where method 900 ends. If a particular fracturing stage is being pumped, method 900 proceeds to step 940 where a pressure response is measured. FIG. 2 illustrates an example of measuring a pressure response as described above.

Method 900 proceeds then to step 950 where screen-out is detected. Screen-out detection can be automatic and can be described, e.g., as above. If screen-out is not detected, method 900 proceeds back to step 920. If screen-out is detected, method 900 proceeds to step 960 where a corrective action is selected to mitigate the screen-out. The corrective action can be based on, e.g., a proppant control model as illustrated in FIGS. 4-6 based on collected field data illustrated in FIG. 3 as described above. The corrective action can also be based on, e.g., a slurry rate control model as illustrated in FIG. 8 based on collected field data illustrated in FIG. 7 as described above. Once a corrective action to mitigate screen-out has been selected, method 900 proceeds to step 970 where a pumping schedule is adjusted according to the selected corrective action. More than one corrective action can be selected at a same time. Computing system 110, injection treatment control subsystem 111, or a combination thereof, as illustrated in FIG. 1 above are examples of systems that can adjust a pumping schedule according to a selected corrective action using pump trucks 116 as described above.

Figure 10:
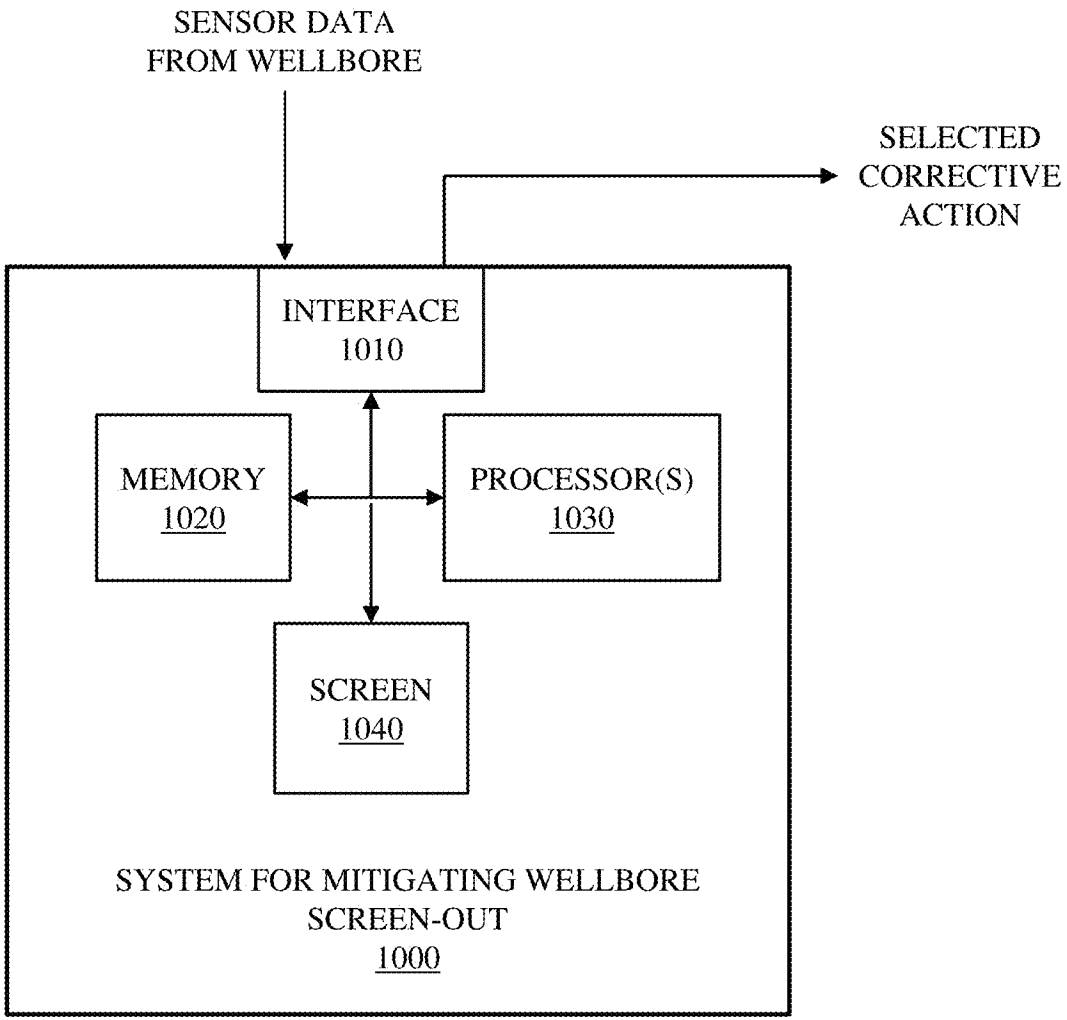
FIG. 10 illustrates a block diagram of an example computing system for use according to the principles of the disclosure.

Computing system 1000, illustrated in FIG. 10, provides an example of injection treatment control subsystem 111 or computing subsystem 110. Computing system 1000 can be located proximate a well site, or a distance from the well site, such as in a data center, cloud environment, corporate location, a lab environment, or another location. Computing system 1000 can be a distributed system having a portion located proximate a well site and a portion located remotely from the well site. Computing system 1000 includes a communications interface 1010, a memory (or data storage) 1020, one or more processors 1030, and a screen 1040.

Communication interface 1010 is configured to transmit and receive data. For example, communication interface 1010 can receive real-time observations of pressure and/or flow of fracturing fluid from pressure and/or flow sensors in, e.g., pump trucks 116 at surface 106 during a stimulation operation, e.g., a hydraulic fracturing operation.

Memory 1020 can be configured to store a series of operating instructions that direct the operation of the one or more processors 1030 when initiated thereby, including code representing the algorithms for determining the proppant control model illustrated in FIGS. 4-6 and described above, the slurry rate control model illustrated in FIG. 8 and described above, or any other control models such as, e.g., the friction reducer model described above. For example, the algorithms can correspond to one or more of equations. 1-3 as described herein. Code for employing sensor data from received real-time observations of pressure and/or flow of fracturing fluid from pressure and/or flow sensors in, e.g., pump trucks 116 at surface 106 during a stimulation operation can also be stored in memory 1020. Memory 1020 is a non-transitory computer readable medium. Memory 1020 can be a distributed memory.

The one or more processors 1030 are configured to determine, e.g., proppant and/or slurry rate control corrective actions based on, e.g., the proppant and/or slurry rate control models described above. Further, the one or more processors 1030 are configured to cause adjustments to a pumping schedule based on the determined proppant and/or slurry rate control corrective actions. The one or more processors 1030 can also be configured for real time monitoring, e.g., of the received real-time observations of pressure and/or flow of fracturing fluid from the pressure and/or flow sensors in, e.g., pump trucks 116. The one or more processors 1030 include the logic to communicate with communications interface 1010 and memory 1020, and perform the functions described herein using sensor data, such as real time sensor data, from sensors associated with the wellbore.

Screen 1040 is configured to display outputs from the one or more processors 1030, such as recommended corrective actions to mitigate screen-out conditions in, e.g., wellbore 102. Screen 1040 can also display a monitoring status. Accordingly, the computing system 1000 can output recommended corrective actions to mitigate screen-out conditions in, e.g., wellbore 102 to a user for the user to select and instruct the computing system 110, injection treatment control subsystem 111, or a combination thereof to implement the recommended corrective action. The recommended corrective action could also, e.g., be implemented automatically without user intervention by the computing system 110, injection treatment control subsystem 111, or a combination thereof.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, because the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Each of the aspects disclosed in the SUMMARY can have one or more of the following additional elements in combination. Element 1: wherein the at least one type of mitigation action is selected from the group consisting of proppant concentration adjustments, fluid rheology adjustments by changing a concentration of friction reducer or other chemicals, and slurry pumping rate adjustments. Element 2: wherein the selection of the at least one type of mitigation action is based on a pressure safety window and a risk from the automatic determination of the onset of the wellbore screen-out. Element 3: wherein the pressure safety window is the difference between a pressure of fracturing fluid measured at a surface of the wellbore and a maximum pressure of the fracturing fluid for the hydraulic fracturing well site. Element 4: wherein the risk is a rate of increase in pressure of fracturing fluid. Element 5: wherein the at least one type of mitigation action is performed automatically. Element 6: wherein the at least one type of mitigation action is performed by a user.

What is claimed is:

1. A method of mitigating wellbore screen-out for a wellbore, the method comprising:

automatically determining an onset of wellbore screen-out when a time it takes for an upward trend of corrected pressure data of hydraulic fluid from a hydraulic fracturing well site to reach a maximum allowable pressure of the hydraulic fluid, relative to a time required to move one wellbore volume of the hydraulic fluid at a present slurry rate, is less than a value based on a current condition of a fracturing operation;

selecting at least one type of mitigation action based on the automatic determination of the onset of the wellbore screen-out; and mitigating the wellbore screen-out with the selected at least one type of mitigation action.

2. The method of claim 1, wherein the at least one type of mitigation action is selected from the group consisting of:

proppant concentration adjustments;

fluid rheology adjustments by changing a concentration of friction reducer or other chemicals; and slurry pumping rate adjustments.

3. The method of claim 2, wherein the selection of the at least one type of mitigation action is based on a pressure safety window and a risk from the automatic determination of the onset of the wellbore screen-out.

4. The method of claim 3, wherein the pressure safety window is a difference between a pressure of fracturing fluid measured at a surface of the wellbore and a maximum pressure of the fracturing fluid for the hydraulic fracturing well site.

5. The method of claim 3, wherein the risk is a rate of increase in pressure of fracturing fluid.

6. The method of claim 1, wherein the at least one type of mitigation action is performed automatically.

7. The method of claim 1, wherein the at least one type of mitigation action is performed by a user.

8. A system for mitigating wellbore screen-out for a wellbore, the system comprising:

at least one surface pressure sensor; and at least one processor configured to perform operations including:

automatically determining an onset of wellbore screen-out when a time it takes for an upward trend of corrected pressure data of hydraulic fluid from the at least one pressure sensor from a hydraulic fracturing well site to reach a maximum allowable pressure of the hydraulic fluid, relative to a time required to move one wellbore volume of the hydraulic fluid at a present slurry rate, is less than a value based on a current condition of a fracturing operation;

selecting at least one type of mitigation action based on the automatic determination of the onset of the wellbore screen-out; and mitigating the wellbore screen-out with the selected at least one type of mitigation action.

9. The system of claim 8, wherein the at least one type of mitigation action is selected from the group consisting of:

proppant concentration adjustments;

fluid rheology adjustments by changing a concentration of friction reducer or other chemicals; and slurry pumping rate adjustments.

10. The system of claim 9, wherein the selection of the at least one type of mitigation action is based on a pressure safety window and a risk from the automatic determination of the onset of the wellbore screen-out.

11. The system of claim 10, wherein the pressure safety window is a difference between a pressure of fracturing fluid measured at a surface of the wellbore with the at least one pressure sensor and a maximum pressure of the fracturing fluid for the hydraulic fracturing wellsite.

12. The system of claim 10, wherein the risk is a rate of increase in pressure of fracturing fluid.

13. The system of claim 8, wherein the at least one type of mitigation action is performed automatically.

14. The system of claim 8, wherein the at least one type of mitigation action is performed by a user.

15. A computer program product having a series of operating instructions stored on a non-transitory computer-readable medium that cause at least one processor to perform operations to mitigate wellbore screen-out for a wellbore, the operations comprising:

automatically determining an onset of wellbore screen-out when a time it takes for an upward trend of corrected pressure data of hydraulic fluid from a hydraulic fracturing well site to reach a maximum allowable pressure of the hydraulic fluid, relative to a time required to move one wellbore volume of the hydraulic fluid at a present slurry rate, is less than a value based on a current condition of a fracturing operation;

selecting at least one type of mitigation action based on the automatic determination of the onset of the wellbore screen-out; and mitigating the wellbore screen-out with the at least one type of mitigation action.

16. The computer program product of claim 15, wherein the at least one type of mitigation action is selected from the group consisting of:

proppant concentration adjustments;

fluid rheology adjustments by changing a concentration of friction reducer or other chemicals; and slurry pumping rate adjustments.

17. The computer program product of claim 16, wherein the selection of the at least one type of mitigation action is based on a pressure safety window and a risk from the automatic determination of the onset of the wellbore screen-out.

18. The computer program product of claim 17, wherein the pressure safety window is a difference between a pressure of fracturing fluid measured at a surface of the wellbore with at least one pressure sensor and a maximum pressure of the fracturing fluid for the hydraulic fracturing well site.

19. The computer program product of claim 17, wherein the risk is a rate of increase in pressure of fracturing fluid.

20. The computer program product of claim 15, wherein the at least one type of mitigation action is performed automatically.

* * * * *